US009027824B2

(12) United States Patent
Harris

(10) Patent No.: US 9,027,824 B2
(45) Date of Patent: May 12, 2015

(54) FOOD CONTAINING DEVICE

(71) Applicant: Debra Lynn Harris, Lake Worth, FL (US)

(72) Inventor: Debra Lynn Harris, Lake Worth, FL (US)

(73) Assignee: Debra L. Harris, Lake Worth, FL (US)

( * ) Notice: Subject to any disclaimer, the term of this patent is extended or adjusted under 35 U.S.C. 154(b) by 0 days.

(21) Appl. No.: 14/189,752

(22) Filed: Feb. 25, 2014

(65) Prior Publication Data

US 2014/0239053 A1 Aug. 28, 2014

Related U.S. Application Data

(60) Provisional application No. 61/770,787, filed on Feb. 28, 2013.

(51) Int. Cl.

| | |
|---|---|
| ***B65D 5/02*** | (2006.01) |
| ***B65D 5/00*** | (2006.01) |
| ***B65D 30/22*** | (2006.01) |

(52) U.S. Cl.

CPC ..... *B65D 5/0254* (2013.01); *B65D 5/008* (2013.01); *B65D 31/12* (2013.01); *Y10S 229/904* (2013.01)

(58) Field of Classification Search

USPC ..... 229/107, 116, 932, 405, 904, 902; 206/436, 551; 220/738, 482

See application file for complete search history.

(56) References Cited

U.S. PATENT DOCUMENTS

| | | | | |
|---|---|---|---|---|
| 1,507,078 | A * | 9/1924 | Mackie | 206/733 |
| 6,216,946 | B1 * | 4/2001 | Cai | 229/400 |
| 6,386,443 | B1 * | 5/2002 | Szczerbinski | 229/400 |
| 6,719,192 | B2 * | 4/2004 | Barcat et al. | 229/400 |

* cited by examiner

*Primary Examiner* — Gary Elkins
*Assistant Examiner* — Christopher Demeree

(57) ABSTRACT

A food containing device is provided. The food containing device may include a cone shaped body having a top end and a bottom end. The bottom end may include the cone tip, and the top end may include the rim. The rim forms an opening that leads into the body. The present invention may include at least one flap attached to and extending radially outward from the cone shaped body. The at least one flap may include at least one opening formed to receive a condiment.

5 Claims, 3 Drawing Sheets

FOOD CONTAINING DEVICE

CROSS-REFERENCE TO RELATED APPLICATION

This application claims the benefit of priority of U.S. provisional application No. 61/770,787, filed Feb. 28, 2013, the contents of which are herein incorporated by reference.

BACKGROUND OF THE INVENTION

The present invention relates to a food containing device and, more particularly, to a device for containing condiments and finger foods.

Finger food is food meant to be eaten directly using the hands, in contrast to food eaten with a knife and fork or other utensils. Foods considered street foods are frequently, though not exclusively, finger foods. Walking and eating food at the same time is difficult and messy, especially in crowded environments like carnivals, festivals and food truck rallies. Current food containers or cones do not make it easy to eat while walking. They are too large or bulky. They do not allow room for sauces or condiments to be used neatly or spill-free.

As can be seen, there is a need for a device that neatly stores finger foods and condiments.

SUMMARY OF THE INVENTION

In one aspect of the present invention, a food containing device comprises: a cone shaped body comprising a top end and a bottom end, wherein the bottom end comprises a tip and the top end comprises a rim forming an opening that leads into the body; and at least one flap attached to and extending radially away from the cone shaped body, wherein the at least one flap comprises at least one opening formed to receive a condiment.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a paper cone with flaps and cutouts for carrying food items. The cone of the present invention allows a user to dip and eat while having more control over the food and keeping hands clean. The cone shape may be similar to a pyramid which makes it easier to grasp. The four cutouts in the flaps can hold small containers which help prevent spilling food out onto clothes and may further add more dipping choices.

Figure 1:
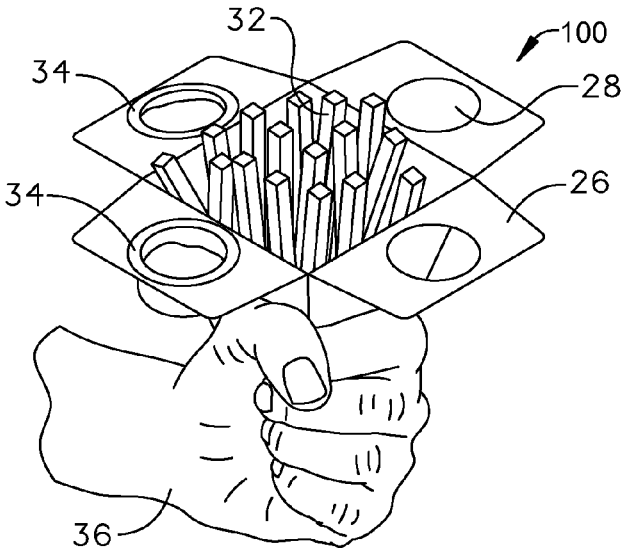
FIG. 1 is a perspective view of the present invention shown in use.
Figure 2:
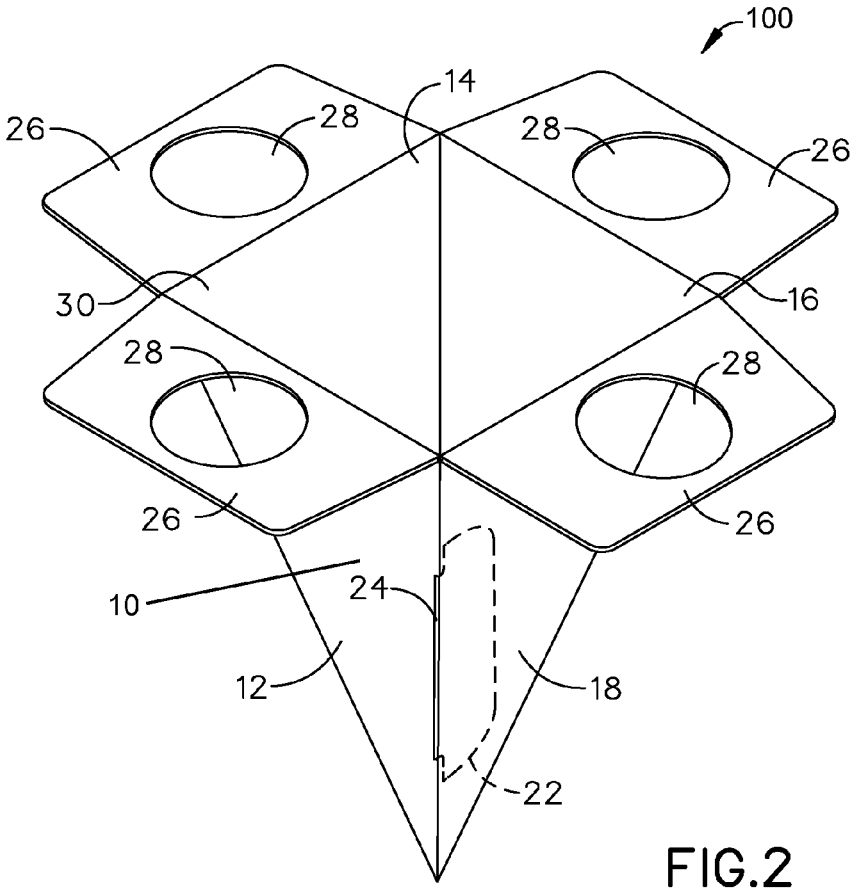
FIG. 2 is a perspective view of the present invention.
Figure 3:
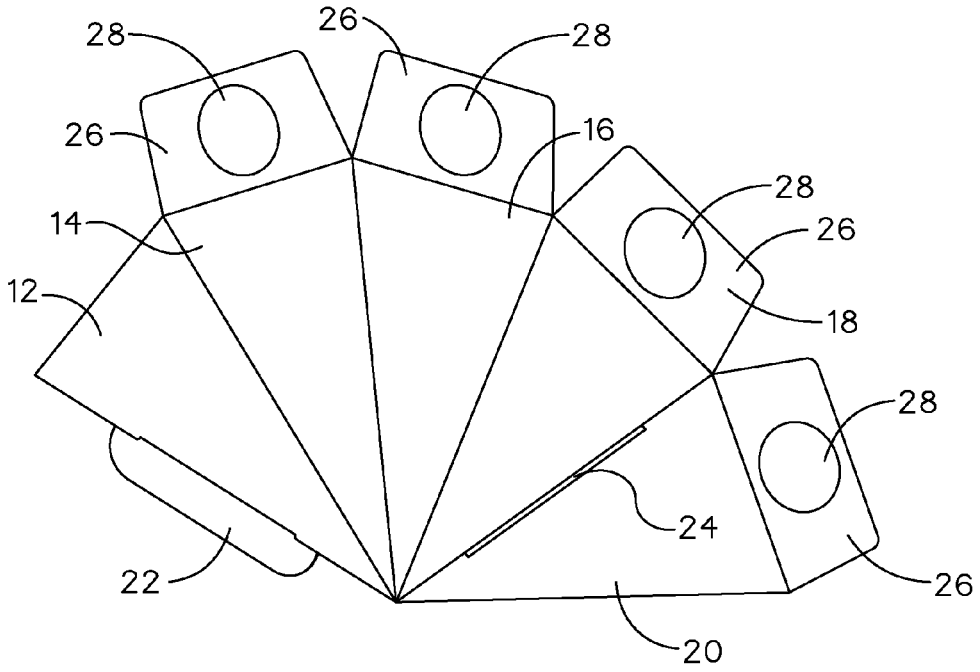
FIG. 3 is a perspective view of the present invention laid flat.
Figure 4:
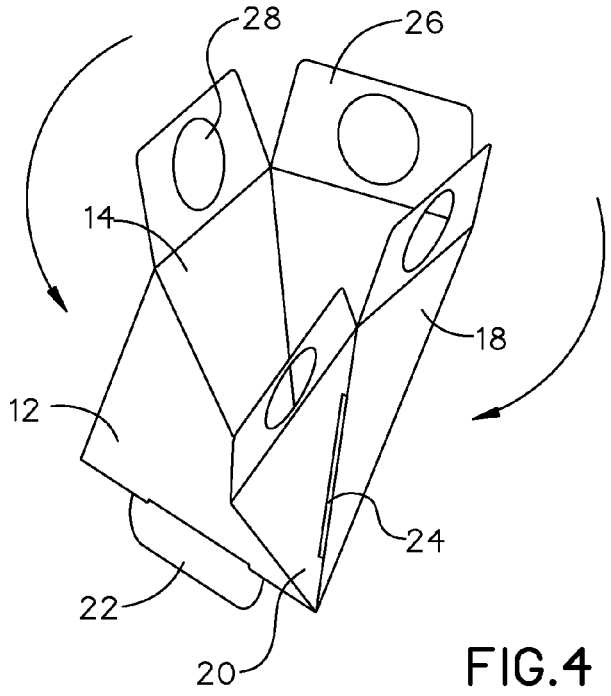
FIG. 4 is a perspective view of the present invention illustrating the construction of the pyramid.
Figure 5:
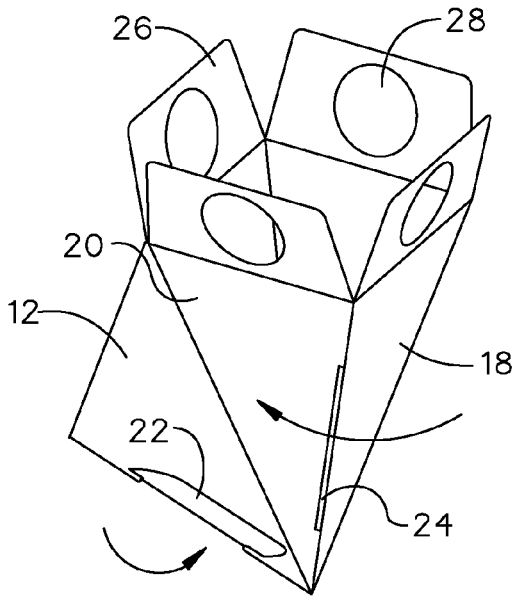
FIG. 5 is a perspective view of the present invention illustrating the construction of the pyramid.
Figure 6:
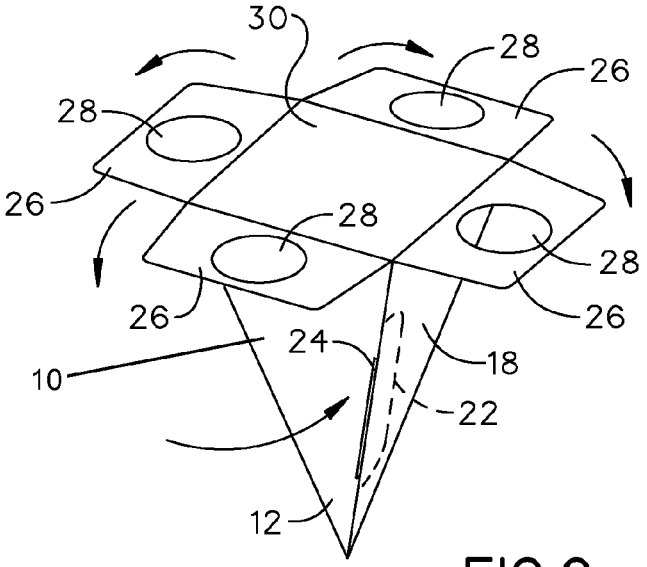
FIG. 6 is a perspective view of the present invention illustrating the final assembly.

Referring to FIGS. 1 through 6, the present invention includes a food containing device 100. The food containing device 100 may include a cone shaped body 10 having a top end and a bottom end. The bottom end may include the cone tip, and the top end may include the rim. The rim forms an opening that leads into the body 10. The present invention may include at least one flap 26 attached to and extending radially outward from the cone shaped body 10. The at least one flap 26 may include at least one opening 28 formed to receive a condiment 34. The cone shaped body 10 may contain finger foods 32.

In certain embodiments, the cone shaped body 10 may be a pyramid with at least a first side 14, a second side 16, and a third side 18. As illustrated in the Figures, the present invention may further include a fourth side 20. Each of the sides 14, 16, 18, 20 may include a flap 26 extending radially from the rim. Therefore, each side may contain the same or a different condiment 34.

In certain embodiments, the present invention may be in an expanded form and a compressed form. The compressed form may be folded into the expanded form. While in the compressed form, the present invention may be easily shipped. In such embodiments, the compressed form may include the first side 14, the second side 16, the third side 18, the fourth side 20, and a connecting side 12. A crease is formed in between each side 12, 14, 16, 18, 20 so that the sides 12, 14, 16, 18, 20 may be folded relative to one another to form the cone shaped body 10. The connecting side 12 may include a tab 22. A slot 24 may be formed in the crease between the third side 18 and the fourth side 20. The tab 22 is formed to fit and secure within the slot 24. Therefore a user may fold the sides 12, 14, 16, 18, 20 along the creases and insert the tab 22 into the slot to for the pyramid cone shaped body 10.

A method of making the present invention may include the following. First choose the desired paper. Then die cut the pattern for the cone for its flat pyramid shape and score along the creases for easy folding. There may be five side panels, a tab and four container flaps. Fold the creases between the sides and at the flaps. Place the tab within the slot to construct the food containing device. Other stronger materials like plastic or rubber can strengthen the design. The circles in the flaps could also be sized differently to fit different size containers.

It should be understood, of course, that the foregoing relates to exemplary embodiments of the invention and that modifications may be made without departing from the spirit and scope of the invention as set forth in the following claims.

What is claimed is:

1. A food containing device comprising:

a cone shaped body comprising a top end and a bottom end, wherein the bottom end comprises a tip and the top end comprises a rim forming an opening that leads into the body; and at least one flap attached to and extending radially away from the cone shaped body, wherein the at least one flap comprises at least one opening formed to receive a condiment; wherein the cone shaped body is a pyramid with at least a first side, a second side, a third side, and a fourth side; and wherein a compressed form comprises the first side, the second side, the third side, the fourth side, and a connecting side, wherein a crease is formed in between each side, wherein the connecting side comprises a tab, and a slot is formed in between the third side and the fourth side, Wherein the tab is formed to fit and secure within the slot.

2. The food containing device of claim 1, wherein the cone shaped body is a pyramid with at least a first side, a second side, and a third side.

3. The food containing device of claim 2, wherein each of the first side, the second side, and the third side each comprises the flap extending from the rim.

4. The food containing device of claim 1, wherein each of the first side, the second side, the third side, and the fourth side each comprises the flap extending from the rim.

5. The food containing device of claim 1, wherein the opening on the at least one flap leads to a condiment receptacle.

* * * * *